US008623806B2

(12) United States Patent
Scialla et al.

(10) Patent No.: US 8,623,806 B2
(45) Date of Patent: Jan. 7, 2014

(54) LIQUID DETERGENT COMPOSITION FOR IMPROVED SHINE

(75) Inventors: Stefano Scialla, Rome (IT); Frank Hulskotter, Bad Duerkheim (DE); Gloria DiCapua, Ardea (IT); Patrick Firmin August Delplancke, Steenhuize-Wijnheuize (BE); Marc François Theophile Evers, Strombeek-Bever (BE); Rainer (Anton) Dobrawa, Stuttgart (DE); Sophia Ebert, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 70 days.

(21) Appl. No.: 13/469,624

(22) Filed: May 11, 2012

(65) Prior Publication Data

US 2013/0303426 A1 Nov. 14, 2013

(51) Int. Cl.

| | |
|---|---|
| ***C11D 1/02*** | (2006.01) |
| ***C11D 1/75*** | (2006.01) |
| ***C11D 3/30*** | (2006.01) |

(52) U.S. Cl.

USPC ..... 510/237; 510/235; 510/423; 510/426; 510/427; 510/432; 510/499; 510/503; 510/505

(58) Field of Classification Search

USPC ..... 510/235, 237, 423, 426, 427, 432, 499, 510/503, 505; 134/25.2

See application file for complete search history.

(56) References Cited

U.S. PATENT DOCUMENTS

| | | | | |
|---|---|---|---|---|
| 6,500,796 | B1 | 12/2002 | Ceulemans et al. | |
| 2003/0154556 | A1 | 8/2003 | Del Duca et al. | |
| 2007/0275868 | A1 | 11/2007 | Cooremans et al. | |
| 2011/0036374 | A1 * | 2/2011 | Schneiderman et al. | 134/6 |

FOREIGN PATENT DOCUMENTS

| | | | |
|---|---|---|---|
| WO | WO 97/42294 | A1 | 11/1997 |
| WO | WO 2011/051646 | A1 | 5/2011 |

OTHER PUBLICATIONS

International Search Report; International Application No. PCT/US2013/040307; date of mailing Jul. 18, 2013; 4 pages.
U.S. Appl. No. 13/469,608, filed May 11, 2012, Scialla, et al.

* cited by examiner

*Primary Examiner* — Gregory Delcotto
(74) *Attorney, Agent, or Firm* — John T. Dipre; Steven W. Miller

(57) ABSTRACT

A liquid detergent composition having a modified polyethyleneimine polymer and a surfactant to provide improved shine on hard surfaces.

18 Claims, No Drawings

LIQUID DETERGENT COMPOSITION FOR IMPROVED SHINE

FIELD OF INVENTION

The present invention relates to a liquid detergent composition comprising a modified polyethyleneimine polymer and a surfactant to provide improved shine on hard surfaces.

BACKGROUND OF THE INVENTION

Surface cleaning with liquid detergents poses an ongoing problem for consumers. Consumers utilizing liquid detergents as a light-duty liquid dishwashing detergent composition or as a hard surface cleaning composition frequently find surface imperfections such as soil residues, streaks, film and/or spots after washing. Hence, there remains a need for liquid cleaning compositions which not only clean hard surfaces, but also deliver improved shine.

It has surprisingly been found that the compositions of the present invention are not only effective in cleaning surfaces, but also provide an improved shine benefit when used for light-duty dishwashing or for hard surface cleaning.

SUMMARY OF THE INVENTION

The present application relates to a liquid cleaning composition comprising a) from about 0.01% to about 1.5% by weight of the composition of a modified polyethyleneimine polymer comprising (1) a polyethyleneimine backbone; (2) a polyoxyethylene chain having an average of from about 1 to about 30 ethylene oxide units per unit of NH in the polyethyleneimine backbone; (3) a quaternization degree between about 50% and about 100%; and b) from about 0.5% to about 40% by weight of the composition of surfactant.

All documents cited are, in relevant part, incorporated herein by reference; the citation of any document is not to be construed as an admission that it is relevant art with respect to the present invention.

DETAILED DESCRIPTION OF THE INVENTION

The Composition

The composition according to the present invention is designed to provide fast drying and/or to deliver shine on hard surfaces.

The composition according to the present invention may be in a form selected from the group consisting of a liquid, a gel, and a solid. Preferably, the composition according to the present invention is a liquid or gel composition.

The composition of the present invention may be a hard surface cleaning detergent composition, a hand dishwashing detergent composition, or an automatic dishwashing detergent composition. In a preferred embodiment, the hard surface cleaning composition is used to provide fast drying and/or to deliver shine on household hard surfaces. In an alternatively preferred embodiment, the hand dishwashing detergent composition is used to provide fast drying and/or to deliver shine on dishes, flatware, glassware, cutlery, etc. in a hand dishwashing cleaning operation.

In another preferred embodiment, the automatic dishwashing composition is used to provide fast drying and/or to deliver shine on dishes, flatware, glassware, cutlery, etc. in an automatic dishwashing operation.

In one preferred embodiment, the composition is a hard surface cleaning composition, the composition comprises from about 70% to about 99%, preferably from about 75% to about 95%, and more preferably from about 80% to about 95% by weight of the total composition, of water.

Alternatively, in another preferred embodiment, the composition is a hand dishwashing detergent composition, the composition comprises from about 30% to about 95%, preferably from about 40% to about 80%, and more preferably from about 50% to about 75% by weight of the total composition, of water.

In the preferred embodiment wherein the composition is a hard surface cleaning composition, the composition has a pH from about 2 to about 14, preferably from about 2 to about 10, more preferably from about 2 to about 9.5, and even more preferably from about 2.1 to about 8, as is measured at 25° C. In the preferred embodiment wherein the composition is a hand dishwashing detergent composition, the composition has a pH from about 3 to about 14, preferably from about 6 to about 13, most preferably from about 8 to about 11.

In one preferred embodiment wherein the composition is a hard surface cleaning composition, the composition has a water-like viscosity. By "water-like viscosity" it is meant herein a viscosity that is close to that of water. Preferably, the composition herein has a viscosity of up to about 50 cps, more preferably from about 0 cps to about 30 cps, yet more preferably from about 0 cps to about 20 cps, and most preferably from about 0 cps to about 10 cps at 60 rpm and 20° C., when measured with a Brookfield digital viscometer model DV II, with spindle 2.

In another preferred embodiment, wherein the composition is a hard surface cleaning composition, the composition of the present invention is a thickened composition. Thus, the composition herein preferably has a viscosity of from about 50 cps to about 5000 cps, more preferably from about 50 cps to about 2000 cps, yet more preferably from about 50 cps to about 1000 cps, and most preferably from about 50 cps to about 500 cps at 20 $s^{-1}$ and 20° C., when measured with a Rheometer, model AR 1000 (Supplied by TA Instruments) with a 4 cm conic spindle in stainless steel, 2° angle (linear increment from 0.1 to 100 $sec^{-1}$ in maximum 8 minutes). Preferably, the thickened composition according to the embodiment is a shear-thinning composition. The thickened composition herein preferably comprises a thickener, more preferably a polysaccharide polymer thickener, still more preferably a gum-type polysaccharide polymer thickener, and most preferably a Xanthan gum thickener. In one preferred embodiment, the thickener may be micro fibril cellulose.

Alternatively, in the preferred embodiment wherein the composition is a hand dishwashing detergent composition, the composition preferably has a viscosity from about 50 cps to 2000 cps, yet more preferably from about 100 cps to about 1500 cps, and most preferably from about 500 cps to about 1300 cps at 20 $s^{-1}$ and 20° C.

Incorporated and included herein, as if expressly written herein, are all ranges of numbers when written in a "from X to Y" or "from about X to about Y" format. It should be understood that every limit given throughout this specification will include every lower or higher limit, as the case may be, as if such lower or higher limit was expressly written herein. Every range given throughout this specification will include every narrower range that falls within such broader range, as if such narrower ranges were all expressly written herein.

Unless otherwise indicated, weight percentage is in reference to weight percentage of the liquid detergent composition. All temperatures, unless otherwise indicated are in Celsius.

Modified Polyethyleneimine Polymer

The present composition may comprise from about 0.01 wt % to about 1.5 wt %, more preferably from about 0.05% to about 1.0% by weight of the composition of an alkoxylated polyethyleneimine polymer which is also quaternized. In one preferred embodiment, the alkoxylated polyethyleneimine polymer is an ethoxylated polyethyleneimine polymer which is also quaternized.

The alkoxylated polyethyleneimine polymer of the present composition has a polyethyleneimine backbone. Preferably, the polyethyleneimine backbone has a weight average molecular weight of from about 400 g/mol to about 10000 g/mol. In one embodiment, the weight average molecular weight is preferably from about 400 g/mol to about 2000 g/mol, more preferably from about 600 g/mol to about 1800 g/mol, most preferably about 600 or about 1800. Alternatively, in another embodiment, the polyethyleneimine backbone has a weight average molecular weight from about 3000 g/mol to about 7000 g/mol, preferably from about 4000 g/mol to about 6000 g/mol, and most preferably about 5000.

The modification of the polyethyleneimine backbone includes: (1) one or two alkoxylation modifications per nitrogen atom, dependent on whether the modification occurs at an internal nitrogen atom or at an terminal nitrogen atom, in the polyethyleneimine backbone, the alkoxylation modification consisting of the replacement of a hydrogen atom on a polyalkoxylene chain having an average of about 1 to about 30 alkoxy moieties per modification, wherein the terminal alkoxy moiety of the alkoxylation modification is capped with hydrogen, a $C_1$-$C_4$ alkyl or mixtures thereof; (2) quaternization of a tertiary nitrogen atom, bearing 0, 1, or 2 polyalkoxylene chains. The quaternization is achieved preferably by introducing $C_1$-$C_{12}$ alkyl, aryl or alkylaryl groups and may be undertaken in a customary manner by reaction with corresponding alkyl-, alkylaryl-, halides and dialkylsulfates.

For example, but not limited to, below is shown possible modifications to terminal nitrogen atoms in the polyethyleneimine backbone where R represents an ethylene spacer and E represents a $C_1$-$C_{12}$ alkyl moiety and $X^-$ represents a suitable water soluble counterion, such as chlorine, bromine or iodine, sulphate (i.e. –O—SO3H or —O—SO3-), alkylsulfonate such as methylsulfonate, arylsulfonate such as tolylsulfonate, and alkyl sulphate, such as methosulphate (i.e. —O—SO2-OMe).

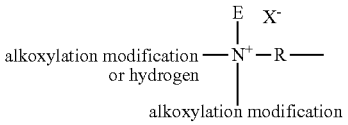

or

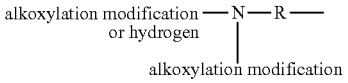

Also, for example, but not limited to, below is shown possible modifications to internal nitrogen atoms in the polyethyleneimine backbone where R represents an ethylene spacer, E represents a $C_1$-$C_{12}$ alkyl moiety and X— represents a suitable water soluble counterion.

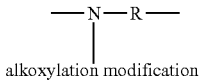

or

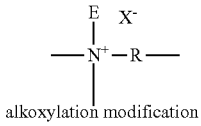

Also, for example, but not limited to, below is shown possible modifications to internal nitrogen atoms in the polyethyleneimine backbone where R represents an ethylene spacer and E represents a $C_1$-$C_{12}$ alkyl moiety and X— represents a suitable water soluble counterion.

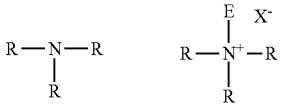

The alkoxylation modification of the polyethyleneimine backbone consists of the replacement of a hydrogen atom by a polyalkoxylene chain having an average of about 1 to about 30 alkoxy units, preferably about 2 to about 25 alkoxy units, and more preferably about 3 to about 20 alkoxy units. The alkoxy unit is preferably an ethoxy (EO) unit. Alternatively, some of the alkoxy units may be 1,2-propoxy (1,2-PO), 1,2-butoxy (1,2-BO), and combinations thereof, provided the ethoxy units constitute greater than about 90 mol % of the alkoxylation, and more preferably greater than about 95 mol %. In one especially preferred embodiment, there are no alkoxy units other than ethoxy.

The alkoxylated polyethyleneimines are quaternized. The degree of permanent quaternization may be from about 50% to about 100% of the polyethyleneimine backbone nitrogen atoms.

A preferred modified polyethyleneimine has the general structure of formula (I):

formula (I)

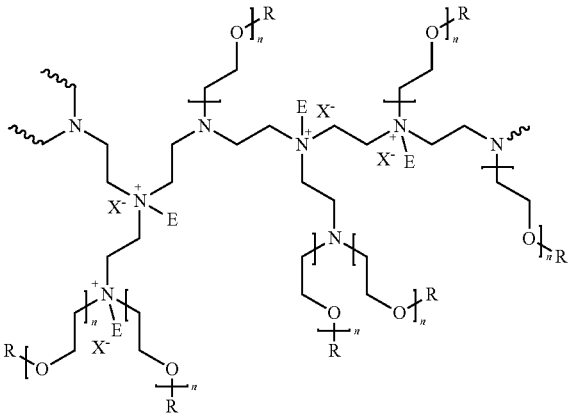

wherein the polyethyleneimine backbone has a weight average molecular weight of about 400 to about 10000, n of formula (I) may be between about 1 and about 30, and R of formula (I) is selected from hydrogen, a $C_1$-$C_4$ alkyl and mixtures thereof, E represents a $C_1$-$C_{12}$ alkyl moiety and $X^-$ represents a suitable water soluble counterion. The degree of quaternization of formula (I) may be from about 50% to about 100% of the polyethyleneimine backbone nitrogen atoms. Preferably the R is a hydrogen atom. Quaternization is preferably achieved by reaction with dimethyl sulfate.

Another polyethyleneimine has the general structure of formula (II):

formula (II)

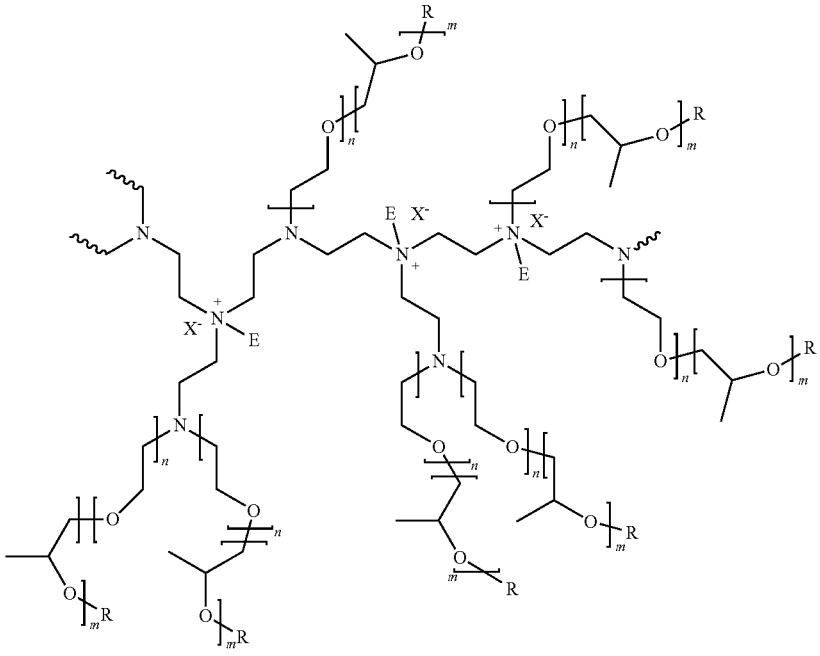

wherein the polyethyleneimine backbone has a weight average molecular weight from about 400 to about 10000, n of formula (II) has a range of from about 30 to about 80, m of formula (II) is less than 10% of n, and R of formula (II) is selected from hydrogen, a $C_1$-$C_4$ alkyl and mixtures thereof, E represents a $C_1$-$C_{12}$ alkyl moiety and $X^-$ represents a suitable water soluble counterion. The degree of permanent quaternization of formula (II) may be from 50% to about 100% of the polyethyleneimine backbone nitrogen atoms.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like as described in the Examples below.

The inventive alkoxylated polyethyleneimines may be prepared in a known manner by reaction of polyethyleneimines with alkylene oxides. Suitable alkylene oxides are $C_2$-$C_{20}$ alkylene oxides like ethylene oxide, propylene oxide, butylene oxide, pentene oxide, hexene oxide, decene oxide, dodecene oxide etc. Polyethyleneimines are reacted with one single alkylene oxide or combinations of two or more different alkylene oxides. Using two or more different alkylene oxides, the resulting polymer can be obtained as a block-wise structure or a random structure.

One preferred procedure consists in initially undertaking only an incipient alkoxylation of the polyethyleneimine in a first step. In this step, the polyethyleneimine is reacted only with a portion of the total amount of alkylene oxide used, which corresponds to about 1 mol of alkylene oxide per mole of NH moiety. This reaction is undertaken generally in the absence of a catalyst in an aqueous solution at a reaction temperature from about 70 to about 200° C. and preferably from about 80 to about 160° C. This reaction may be affected at a pressure of up to about 10 bar, and in particular up to about 8 bar.

In a second step, the further alkoxylation is then effected by subsequent reaction with the remaining amount of alkylene oxide. The further alkoxylation is undertaken typically in the presence of a basic catalyst. Examples of suitable catalysts are alkali metal and alkaline earth metal hydroxides such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides such as sodium hydride and calcium hydride, and alkali metal carbonates such as sodium carbonate and potassium carbonate. Preference is given to the alkali metal hydroxides and the alkali metal alkoxides, particular preference being given to potassium hydroxide and sodium hydroxide. Typical use amounts for the base are from 0.05 to 10% by weight, in particular from 0.5 to 2% by weight, based on the total amount of polyethyleneimine and alkylene oxide.

The further alkoxylation may be undertaken in substance (variant a)) or in an organic solvent (variant b)). In variant a), the aqueous solution of the incipiently alkoxylated polyalkylenimine obtained in the first step, after addition of the catalyst, is initially dewatered. This can be done in a simple manner by heating to from about 80 to about 150° C. and distilling off the water under a reduced pressure of from about 0.01 to about 0.5 bar. The subsequent reaction with the alkylene oxide is effected typically at a reaction temperature from about 70 to about 200° C. and preferably from about 100 to about 180° C. The subsequent reaction with the alkylene oxide is effected typically at a pressure of up to about 1.0 bar and in particular up to 8 bar. The reaction time of the subsequent reaction with the alkylene oxide is generally about 0.5 to about 4 hours.

Suitable organic solvents for variant b) are in particular nonpolar and polar aprotic organic solvents. Examples of particularly suitable nonpolar aprotic solvents include aliphatic and aromatic hydrocarbons such as hexane, cyclohexane, toluene and xylene. Examples of particularly suitable polar aprotic solvents are ethers, in particular cyclic ethers such as tetrahydrofuran and dioxane, N,N-dialkylamides such as dimethylformamide and dimethylacetamide, and N-alkyllactams such as N-methylpyrrolidone. It is of course also possible to use mixtures of these organic solvents. Preferred organic solvents are xylene and toluene.

In variant b), the solution obtained in the first step, after addition of catalyst and solvent, is initially dewatered, which is advantageously done by separating out the water at a temperature of from about 120 to about 180° C., preferably supported by a gentle nitrogen stream. The subsequent reaction with the alkylene oxide may be effected as in variant a). In variant a), the alkoxylated polyalkylenimine is obtained directly in substance and may be converted if desired to an aqueous solution. In variant b), the organic solvent is typically removed and replaced by water. The products may, of course, also be isolated in substance.

The quaternization of alkoxylated polyethyleneimines is achieved preferably by introducing $C_1$-$C_{12}$ alkyl, aryl or alkylaryl groups and may be undertaken in a customary manner by reaction with corresponding alkyl-, alkylaryl-, halides and dialkylsulfates, as described for example in WO2009060059.

The quaternization of alkoxylated polyethyleneimines is achieved preferably by reacting the amines with at least one alkylating compound, which is selected from the compounds of the formula EX, wherein E is C1-C12 alkyl, aryl or alkyl and X is a leaving group, which is capable of being replaced by nitrogen (and C2-C6 alkylene oxide, especially ethylene oxide or propylene oxide).

Suitable leaving groups X are halogen, especially chlorine, bromine or iodine, sulphate (i.e. —OSO3H or —OSO3-), alkylsulfonate such as methylsulfonate, arylsulfonate such as tolylsulfonate, and alkyl sulphate, such as methosulphate (i.e. OSO2 OMe). Preferred alkylating agents EX are C1-C12 alkyl halides, bis(C1-C12-alkyl)sulfates, and benzyl halides. Examples of such alkylating agents are ethyl chloride, ethyl bromide, methyl chloride, methyl bromide, benzyl chloride, dimethyl sulphate, diethyl sulphate.

SYNTHESIS EXAMPLES

The amount of alkylating agent determines the amount of quaternization of the amino groups in the polymer, i.e. the amount of quaternized moieties.

The amount of the quaternized moieties can be calculated from the difference of the amine number in the non-quaternized amine and the quaternized amine. The amine number can be determined according to the method described in DIN 16945.

The reaction can be carried out without any solvent, However, a solvent or diluent like water, acetonitrile, dimethylsulfoxide, N-Methylpyrrolidone, etc. may be used. The reaction temperature is usually in the range from 10° C. to 150° C. and is preferably from 50° C. to 110° C.

Example 1

Synthesis of PEI5000+7EO/NH, 50% quaternized with dimethyl sulfate a) PE15000+1EO/NH In a 3.5 l autoclave 2568.0 g of a polyethyleneimine 5000 (average molecular weight $M_w$ of 5000, 50% solution in water) were heated to 80° C. and purged three times with nitrogen up to a pressure of 5 bar. After the temperature had been increased to 110° C., 1314.2 g ethylene oxide were added in portions up to 7 bar. To complete the reaction, the mixture was allowed to post-react for 2 h at 110° C. The reaction mixture was stripped with nitrogen and volatile compounds were removed in vacuum at 70° C. The temperature was increased to 90-110° C. and the mixture was dewatered for 2 hours in vacuum.

2580.0 g of polyethyleneimine 5000 with 1 mole of ethylene oxide per mole NH were obtained as a dark brown viscous oil (Amine value: 512 mg KOH/g).

b) PE15000+7EO/NH

In a 5 l autoclave 997.6 g of the product obtained in Example 1 a) and 29.9 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 140° C. and 3027.2 g ethylene oxide were added in portions up to 7 bar. To complete the reaction, the mixture was allowed to post-react for 2 h at 120° C. The reaction mixture was stripped with nitrogen and volatile compounds were removed in vacuum at 70° C.

4040.0 g of a polyethyleneimine 5000 with 7 mole of ethylene oxide per mole NH bond were obtained as a brown viscous liquid (Amine value: 137.4 mg KOH/g; pH of a 10% by weight aqueous solution: 11.7; viscosity (70° C.): 325 mPas).

c) PEI5000+7EO/NH, 50% quaternized with dimethyl sulfate

In a 2 l reaction vessel 1500.0 g of the product from example 1 b) was heated to 70-75° C. under a constant stream of nitrogen. 232.0 g dimethyl sulfate was added within 2 h. The reaction mixture was stirred for additional 2 h at 75° C.

1720.0 g of light brown solid were obtained (Amine value: 63.3 mg KOH/g; pH of a 10% by weight aqueous solution: 7.8; Viscosity (70° C.): 838 mPas).

Example 2

Synthesis of PEI600+10EO/NH, 75% quaternized with dimethyl sulfate a) PEI600+1EO/NH In a 3.5 l autoclave 1328.5 g of a polyethyleneimine 600 (average molecular weight $M_w$ of 600) and 66.4 g water were heated to 80° C. and purged three times with nitrogen up to a pressure of 5 bar. After the temperature had been increased to 120° C., 1359.4 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C. The temperature was increased to 90-110° C. and the mixture was dewatered for 2 hours in vacuo.

2688.0 g of polyethyleneimine 600 with 1 mole of ethylene oxide per mole NH were obtained as a yellow viscous oil (Amine value: 549 mg KOH/g; pH of a 1% by weight aqueous solution: 11.06).

b) PEI600+10 EO/NH

In a 5 l autoclave 704.5 g of the product obtained in Example 1 a) and 21.1 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 3206.7 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

3968.0 g of a polyethyleneimine 600 with 10 mole of ethylene oxide per mole NH bond were obtained as a yellow-brown viscous liquid (Amine value: 101.5 mg KOH/g; pH of a 10% by weight aqueous solution: 11.6).

c) PEI600+10 EO/NH, 75% quaternized with dimethyl sulfate

In a 0.5 l reaction vessel 120.0 g of the product from example 1b) was heated to 70-75° C. under a constant stream of nitrogen. 20.5 g dimethyl sulfate was added within 15 min. The reaction mixture was stirred for additional 2 h at 75° C. For adjusting pH, 1.0 g NaOH (50% in water) was added.

110.0 g of light brown solid were obtained (Amine value: 23.5 mg KOH/g; pH of a 10% by weight aqueous solution: 9.3).

Example 3

Synthesis of PEI600+7EO/NH, 75% quaternized with dimethyl sulfate a) PEI600+7 EO/NH In a 2 l autoclave 261.0 g of the product obtained in Example 1 a) and 7.8 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 792.0 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

1056.0 g of a polyethyleneimine 600 with 7 mole of ethylene oxide per mole NH bond were obtained as a yellow-brown viscous liquid (Amine value: 147.8 mg KOH/g; pH of a 10% by weight aqueous solution: 11.6).

b) PEI600+7 EO/NH, 75% quaternized with dimethyl sulfate

In a 0.5 l reaction vessel 250.0 g of the product from example 2 a) was heated to 70-75° C. under a constant stream of nitrogen. 58.4 g dimethyl sulfate was added within 15 min. The reaction mixture was stirred for additional 2 h at 75° C.

299.0 g of light brown solid were obtained (Amine value: 35.84 mg KOH/g; pH of a 10% by weight aqueous solution: 6.0; Iodine color number (10% in water): 4.0).

Surfactant

Surfactants may be desired herein as they contribute to the cleaning performance of the liquid cleaning compositions of the present invention. Suitable surfactants are selected from the group consisting of a nonionic surfactant or a mixture thereof; an anionic surfactant or a mixture thereof; an amphoteric surfactant or a mixture thereof; a zwitterionic surfactant or a mixture thereof; a cationic surfactant or a mixture thereof; and mixtures thereof.

In the preferred embodiment wherein the composition is a hard surface cleaning composition, the composition comprises from about 1% to about 60%, preferably from about 5% to about 30%, and more preferably from about 10% to about 0.25% by weight of the total composition of a surfactant.

In the preferred embodiment wherein the composition is a hand dishwashing detergent composition, the composition may comprise from about 5% to about 80%, preferably from about 10% to about 60%, more preferably from about 12% to about 45% by weight of the total composition of a surfactant. In preferred embodiments, the surfactant herein has an average branching of the alkyl chain(s) of more than about 10%, preferably more than about 20%, more preferably more than about 30%, and even more preferably more than about 40% by weight of the total surfactant.

Nonionic Surfactant

In one preferred embodiment, the liquid cleaning composition comprises a nonionic surfactant. Suitable nonionic surfactants may be alkoxylated alcohol nonionic surfactants, which can be readily made by condensation processes which are well-known in the art. However, a great variety of such alkoxylated alcohols, especially ethoxylated and/or propoxylated alcohols, are commercially available. Surfactant catalogs are available which list a number of such surfactants, including nonionics.

Accordingly, preferred alkoxylated alcohols for use herein are nonionic surfactants according to the formula $R^1O(E)_e(P)_pH$ where $R^1$ is a hydrocarbon chain of from about 2 to about 24 carbon atoms, E is ethylene oxide, P is propylene oxide, and e and p which represent the average degree of, respectively ethoxylation and propoxylation, are of from about 0 to about 24 (with the sum of e+p being at least 1). Preferably, the hydrophobic moiety of the nonionic compound can be a primary or secondary, straight or branched alcohol having from about 8 to about 24 carbon atoms.

In some embodiments, preferred nonionic surfactants are the condensation products of ethylene oxide and/or propylene oxide with an alcohol having a straight or branched alkyl chain, having from about 6 to about 22 carbon atoms, preferably from about 9 to about 15 carbon atoms, wherein the degree of alkoxylation (ethoxylation and/or propoxylation) is from about 1 to about 25, preferably from about 2 to about 18, and more preferably from about 5 to about 12 moles of alkylene oxide per mole of alcohol. Particularly preferred are such surfactants containing from about 5 to about 12 moles of ethylene oxide per mole of alcohol. Such suitable nonionic surfactants are commercially available from Shell, for instance, under the trade name Neodol® or from BASF under the trade name Lutensol®.

Preferably, the nonionic surfactant is comprised in a typical amount of from about 2% to about 40%, preferably from about 3% to about 30% by weight of the liquid cleaning composition, and preferably from about 3 to about 20% by weight of the total composition.

Also suitable are alkylpolyglycosides having the formula $R^3O(C_nH_{2n}O)_t(\text{glycosyl})_z$ (formula (III)), wherein $R^3$ of formula (III) is selected from the group consisting of an alkyl or a mixture thereof; an alkyl-phenyl or a mixture thereof; a hydroxyalkyl or a mixture thereof; a hydroxyalkylphenyl or a mixture thereof; and mixtures thereof, in which the alkyl group contains from about 10 to about 18, preferably from about 12 to about 14 carbon atoms; n of formula (III) is about 2 or about 3, preferably about 2; t of formula (III) is from about 0 to about 10, preferably about 0; and z of formula (III) is from about 1.3 to about 10, preferably from about 1.3 to about 3, most preferably from about 1.3 to about 2.7. The glycosyl is preferably derived from glucose. Also suitable are alkyl glycerol ether and sorbitan ester.

Also suitable is fatty acid amide surfactant having the formula (IV):

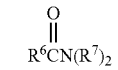

(IV)

wherein $R^6$ of formula (IV) is an alkyl group containing from about 7 to about 21, preferably from about 9 to about 17, carbon atoms, and each $R^7$ of formula (IV) is selected from the group consisting of hydrogen; a $C_1$-$C_4$ alkyl or a mixture thereof; a $C_1$-$C_4$ hydroxyalkyl or a mixture thereof; and a —$(C_2H_4O)_yH$ or a mixture thereof, where y of formula (IV) varies from about 1 to about 3. Preferred amide can be a $C_8$-$C_{20}$ ammonia amide, a monoethanolamide, a diethanolamide, and an isopropanolamide.

Other preferred nonionic surfactants for use in the liquid cleaning composition may be the mixture of nonyl ($C_9$), decyl ($C_{10}$-) undecyl ($C_{11}$) alcohols modified with, on average, about 5 ethylene oxide (EO) units such as the commercially available Neodol 91-5® or the Neodol 91-8® that is modified with on average about 8 EO units. Also suitable are the longer alkyl chains ethoxylated nonionics such as $C_{12}$ or $C_{13}$ modified with 5 EO (Neodol 23-5®). Neodol® is a Shell tradename. Also suitable is the $C_{12}$ or $C_{14}$ alkyl chain with 7 EO, commercially available under the trade name Novel 1412-7® (Sasol) or the Lutensol A 7 N® (BASF).

Preferred branched nonionic surfactants are the Guerbet $C_{10}$ alcohol ethoxylates with 5 EO such as Ethylan 1005, Lutensol XP 50® and the Guerbet $C_{10}$ alcohol alkoxylated nonionics (modified with EO and PO (propylene oxide)) such as the commercially available Lutensol XL® series (X150, XL70, etc). Other branching also includes oxo branched nonionic surfactants such as the Lutensol ON 50® (5 EO) and Lutensol ON70® (7 EO). Other suitable branched nonionics are the ones derived from the isotridecyl alcohol and modified with ethylene oxide such as the Lutensol TO7® (7EO) from BASF and the Marlipal O 13/70® (7 EO) from Sasol. Also suitable are the ethoxylated fatty alcohols originating from the Fisher & Tropsch reaction comprising up to about 50% branching (about 40% methyl (mono or bi) about 10% cyclohexyl) such as those produced from the Safol® alcohols from Sasol; ethoxylated fatty alcohols originating from the oxo reaction wherein at least 50 wt % of the alcohol is $C_2$ isomer (methyl to pentyl) such as those produced from the Isalchem® alcohols or Lial® alcohols from Sasol; the ethoxylated fatty alcohols originating from the modified oxo reaction wherein at least about 15% by weight of the alcohol is $C_2$ isomer (methyl to pentyl) such as those produced from the Neodol® alcohols from Shell.

In one preferred embodiment, the weight ratio of total surfactant to nonionic surfactant is from about 2 to about 10, preferably from about 2 to about 7.5, more preferably from about 2 to about 6.

Anionic Surfactant

Suitable anionic surfactants for use in the liquid cleaning composition can be a sulfate, a sulfosuccinate, a sulfoacetate, and/or a sulphonate; preferably an alkyl sulfate and/or an alkyl ethoxy sulfate; more preferably a combination of an alkyl sulfate and/or an alkyl ethoxy sulfate with a combined ethoxylation degree less than about 5, preferably less than about 3, more preferably less than about 2.

Sulphate or sulphonate surfactant is typically present at a level of at least about 5%, preferably from about 5% to about 40%, and more preferably from about 15% to about 30%, and even more preferably at about 15% to about 25% by weight of the liquid cleaning composition.

Suitable sulphate or sulphonate surfactants for use in the liquid cleaning composition include water-soluble salts or acids of $C_8$-$C_{14}$ alkyl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises a $C_{1-4}$ alkyl branching unit. The average percentage branching of the sulphate or sulphonate surfactant is preferably greater than about 30%, more preferably from about 35% to about 80%, and most preferably from about 40% to about 60% of the total hydrocarbyl chain. One particularly suitable linear alkyl sulphonate includes $C_8$ sulphonate like Witconate NAS 8® commercially available from Witco.

The sulphate or sulphonate surfactants may be selected from a $C_{11}$-$C_{18}$ alkyl benzene sulphonate (LAS), a $C_8$-$C_{20}$ primary, a branched-chain and random alkyl sulphate (AS); a $C_{10}$-$C_{18}$ secondary (2,3) alkyl sulphate; a $C_{10}$-$C_{18}$ alkyl alkoxy sulphate ($AE_xS$) wherein preferably x is from 1-30; a $C_{10}$-$C_{18}$ alkyl alkoxy carboxylate preferably comprising about 1-5 ethoxy units; a mid-chain branched alkyl sulphate as discussed in U.S. Pat. No. 6,020,303 and U.S. Pat. No. 6,060,443; a mid-chain branched alkyl alkoxy sulphate as discussed in U.S. Pat. No. 6,008,181 and U.S. Pat. No. 6,020,303; a modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; a methyl ester sulphonate (MES); and an alpha-olefin sulphonate (AOS).

The paraffin sulphonate may be monosulphonate or disulphonate and usually are mixtures thereof, obtained by sulphonating a paraffin of about 10 to about 20 carbon atoms. Preferred sulphonates are those of $C_{12-18}$ carbon atoms chains and more preferably they are $C_{14-17}$ chains. Paraffin sulphonates that have the sulphonate group(s) distributed along the paraffin chain are described in U.S. Pat. No. 2,503,280; U.S. Pat. No. 2,507,088; U.S. Pat. No. 3,260,744; and U.S. Pat. No. 3,372,188.

Also suitable are the alkyl glyceryl sulphonate surfactant and/or alkyl glyceryl sulphate surfactant described in the Procter & Gamble patent application WO06/014740: A mixture of oligomeric alkyl glyceryl sulphonate and/or sulfate surfactant selected from a dimmer or a mixture thereof; a trimer or a mixture thereof; a tetramer or a mixture thereof; a pentamer or a mixture thereof; a hexamer or a mixture thereof; a heptamer or a mixture thereof; and mixtures thereof; wherein the alkyl glyceryl sulphonate and/or sulfate surfactant mixture comprises from about 0% to about 60% by weight of the monomers.

Other suitable anionic surfactants are alkyl, preferably dialkyl sulfosuccinate and/or sulfoacetate. The dialkyl sulfosuccinate may be a $C_{6-15}$ linear or branched dialkyl sulfosuccinate. The alkyl moiety may be symmetrical (i.e., the same alkyl moieties) or asymmetrical (i.e., different alkyl moieties). Preferably, the alkyl moiety is symmetrical.

Most common branched anionic alkyl ether sulphates are obtained via sulfation of a mixture of the branched alcohols and the branched alcohol ethoxylates. Also suitable are the sulfated fatty alcohols originating from the Fischer & Tropsh reaction comprising up to about 50% branching (about 40% methyl (mono or bi) about 10% cyclohexyl) such as those produced from the safol alcohols from Sasol; sulfated fatty alcohols originating from the oxo reaction wherein at least about 50% by weight of the alcohol is $C_2$ isomer (methyl to pentyl) such as those produced from the Isalchem® alcohols or Lial® alcohols from Sasol; the sulfated fatty alcohols originating from the modified oxo reaction wherein at least about 15% by weight of the alcohol is $C_2$ isomer (methyl to pentyl) such as those produced from the Neodol® alcohols from Shell.

Zwitterionic Surfactant and Amphoteric Surfactant

The zwitterionic and amphoteric surfactants for use in the liquid cleaning composition can be comprised at a level of from about 0.01% to about 20%, preferably from about 0.2% to about 15%, more preferably from about 0.5% to about 10% by weight of the hand dishwashing detergent composition.

Suitable zwitterionic surfactant in the preferred embodiment wherein contains both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylate and sulphonate, although other groups like sulfate, phosphonate, and the like can be used.

The liquid cleaning compositions may preferably further comprise an amine oxide and/or a betaine. Most preferred amine oxides are coconut dimethyl amine oxide or coconut amido propyl dimethyl amine oxide. Amine oxide may have a linear or mid-branched alkyl moiety. Typical linear amine oxides include water-soluble amine oxide containing one $R^4C_{8-18}$ alkyl moiety and 2 $R^5$ and $R^8$ moieties selected from the group consisting of a $C_{1-3}$ alkyl group and a mixtures thereof; and a $C_{1-3}$ hydroxyalkyl group and a mixture thereof. Preferably amine oxide is characterized by the formula $R^4—N(R^5)(R^8)\rightarrow O$ wherein $R^4$ is a $C_{8-18}$ alkyl and $R^5$ and $R^8$ are selected from the group consisting of a methyl; an ethyl; a propyl; an isopropyl; a 2-hydroxethyl; a 2-hydroxypropyl; and a 3-hydroxypropyl. The linear amine oxide surfactant, in particular, may include a linear $C_{10}$-$C_{18}$ alkyl dimethyl amine oxide and a linear $C_8$-$C_{12}$ alkoxy ethyl dihydroxy ethyl amine oxide. Preferred amine oxides include linear $C_{10}$, linear $C_{10}$-$C_{12}$, and linear $C_{12}$-$C_{14}$ alkyl dimethyl amine oxides.

As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from about 10 to about 24 carbon atoms, preferably from about 12 to about 20, and more preferably from about 10 to about 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein, "symmetric" means that $|n_1-n_2|$ is less than or equal to about 5, preferably about 4, most preferably from about 0 to about 4 carbon atoms in at least about 50 wt %, more preferably at least about 75 wt % to about 100 wt % of the mid-branched amine oxide for use herein.

The amine oxide further comprises two moieties, independently selected from a $C_{1-3}$ alkyl; a $C_{1-3}$ hydroxyalkyl group; or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include a betaine such an alkyl betaine, an alkylamidobetaine, an amidazoliniumbetaine, a sulfobetaine (INCI Sultaines), as well as a phosphobetaine, and preferably meets formula I:

$$R^{1'}\text{-}[CO—X(CH_2)_j]_g—N^+(R^{2'})(R^{3'})—(CH_2)_f[CH(OH)—CH_2]_h—Y— \quad (I)$$

wherein $R^{1'}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue;

X is NH, $NR^{4'}$ with $C_{1-4}$ alkyl residue $R^{4'}$, O or S, j is a number from about 1 to about 10, preferably from about 2 to about 5, in particular about 3, g is about 0 or about 1, preferably about 1, $R^{2'}$, $R^{3'}$ are independently a $C_{1-4}$ alkyl residue, potentially hydroxy substituted by such as a hydroxyethyl, preferably by a methyl.

f is a number from about 1 to about 4, in particular about 1, 2 or 3, h is about 0 or 1, and Y is selected from COO, $SO_3$, $OPO(OR^{5'})O$ or $P(O)(OR^{5'})O$, whereby $R^{5'}$ is a hydrogen atom H or a $C_{1-4}$ alkyl residue.

Preferred betaines are the alkyl betaine of the formula ($I_a$), the alkyl amido betaine of the formula ($I_b$), the sulfo betaine of the formula ($I_c$), and the Amido sulfobetaine of the formula ($I_d$);

$$R^{1'}—N^+(CH_3)_2—CH_2COO^- \quad (I_a)$$

$$R^{1'}—CO—NH(CH_2)_3N^+(CH_3)_2—CH_2COO^- \quad (I_b)$$

$$R^{1'}—N^+(CH_3)_2—CH_2CH(OH)CH_2SO_3— \quad (I_c)$$

$$R^{1'}—CO—NH—(CH_2)_3—N^+(CH_3)_2—CH_2CH(OH)CH_2SO_3^- \quad (I_d)$$

in which $R^{1'}$ has the same meaning as in formula I. Particularly preferred betaines are the carbobetaine, wherein $Y^-$ is $[COO^-]$, in particular the carbobetaine of formula ($I_a$) and ($I_b$), more preferred are the alkylamidobetaine of the formula ($I_b$).

Examples of suitable betaines and sulfobetaines are the following (designated in accordance with INCI): almondamidopropyl of betaine, apricotamidopropyl betaine, avocadamidopropyl of betaine, babassuamidopropyl of betaine, behenamidopropyl betaine, behenyl of betaine, betaine, canolamidopropyl betaine, capryl/capramidopropyl betaine, carnitine, cetyl of betaine, cocamidoethyl of betaine, cocamidopropyl betaine, cocamidopropyl hydroxysultaine, coco betaine, coco hydroxysultaine, coco/oleamidopropyl betaine, coco sultaine, decyl of betaine, dihydroxyethyl oleyl glycinate, dihydroxyethyl soy glycinate, dihydroxyethyl stearyl glycinate, dihydroxyethyl tallow glycinate, dimethicone propyl of PG-betaine, drucamidopropyl hydroxysultaine, hydrogenated tallow of betaine, isostearamidopropyl betaine, lauramidopropyl betaine, lauryl of betaine, lauryl hydroxysultaine, lauryl sultaine, milk amidopropyl betaine, milkamidopropyl of betaine, myristamidopropyl betaine, myristyl of betaine, oleamidopropyl betaine, oleamidopropyl hydroxysultaine, oleyl of betaine, olivamidopropyl of betaine, palmamidopropyl betaine, palmitamidopropyl betaine, palmitoyl carnitine, palm kernel amidopropyl betaine, polytetrafluoroethylene acetoxypropyl of betaine, ricinoleamidopropyl betaine, sesamidopropyl betaine, soyamidopropyl betaine, stearamidopropyl betaine, stearyl of betaine, tallowamidopropyl betaine, tallowamidopropyl hydroxysultaine, tallow of betaine, tallow dihydroxyethyl of betaine, undecylenamidopropyl betaine and wheat germ amidopropyl betaine. Preferred betaine is for example cocoamidopropyl betaine.

For example coconut dimethyl betaine is commercially available from Seppic under the trade name of Amonyl 265®. Lauryl betaine is commercially available from Albright & Wilson under the trade name Empigen BB/L®. A further example of betaine is lauryl-imino-dipropionate commercially available from Rhodia under the trade name Mirataine H2C-HA®.

One particularly preferred zwitterionic surfactants for use in the preferred embodiment wherein the composition is a hard surface cleaning composition is the sulfobetaine surfactant, because it delivers optimum soap scum cleaning benefits.

Examples of particularly suitable sulfobetaine surfactants include tallow bis(hydroxyethyl) sulphobetaine and cocoamido propyl hydroxy sulphobetaine which are commercially available from Rhodia and Witco, under the trade name of Mirataine CBS® and Rewoteric AM CAS15® respectively.

Cationic Surfactant

In one preferred embodiment, the liquid cleaning composition can comprise a cationic surfactant present in an effective amount, more preferably from about 0.1% to about 20%, by weight of the liquid cleaning composition. Suitable cationic surfactant is quaternary ammonium surfactant. Suitable quaternary ammonium surfactant is selected from the group consisting of a mono $C_6$-$C_{16}$, preferably a $C_6$-$C_{10}$ N-alkyl or an alkenyl ammonium surfactant or a mixture thereof, wherein the remaining N positions are substituted by a methyl, a hydroxyethyl or a hydroxypropyl group. Another preferred cationic surfactant is a $C_6$-$C_{18}$ alkyl or alkenyl ester of a quaternary ammonium alcohol, such as quaternary chlorine ester. More preferably, the cationic surfactant has formula (V):

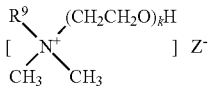

(V)

wherein $R^9$ of formula (V) is a $C_8$-$C_{18}$ hydrocarbyl or a mixture thereof, preferably, a $C_{8-14}$ alkyl, more preferably, a $C_8$, $C_{10}$ or $C_{12}$ alkyl; and Z of formula (V) is an anion, preferably, a chloride or a bromide.

Optional Ingredients

The liquid cleaning composition according to the present invention may comprise a variety of optional ingredients depending on the technical benefit aimed for and the surfaces treated.

Suitable optional ingredients for use herein include an alkaline material or a mixture thereof; an inorganic or organic acid and salt thereof or a mixture thereof; a buffering agent or a mixture thereof; a surface modifying polymer or a mixture thereof; a cleaning polymer or a mixture thereof; a peroxygen bleach or a mixture thereof; a radical scavenger or a mixture thereof; a chelating agent or a mixture thereof; a perfume or a mixture thereof; a dye or a mixture thereof; a hydrotrope or a mixture thereof; a polymeric suds stabilizer or a mixture thereof; a diamine or a mixture thereof; and mixtures thereof.

Solvent

Solvents are generally used to ensure preferred product quality for dissolution, thickness and aesthetics and to ensure better processing. The liquid cleaning composition of the present invention may further comprise a solvent or a mixture thereof, as an optional ingredient. Typically, in the preferred embodiment wherein the composition is a hard surface cleaning composition, the composition may comprise from about 0.1% to about 10%, preferably from about 0.5% to about 5%, and more preferably from about 1% to about 3% by weight of the total composition of a solvent or a mixture thereof. In the preferred embodiment wherein the composition is a hand dishwashing detergent composition, the composition contains from about 0.01% to about 20%, preferably from about 0.5% to about 20%, more preferably from about 1% to about 10% by weight of a solvent.

Suitable solvents herein include $C_1$-$C_5$ alcohols according to the formula $R^{10}$—OH wherein $R^{10}$ is a saturated alkyl group of from about 1 to about 5 carbon atoms, preferably from about 2 to about 4. Suitable alcohols are ethanol, propanol, isopropanol or mixtures thereof. Other suitable alcohols are alkoxylated $C_{1-8}$ alcohols according to the formula $R^{11}$-$(A_q)$-OH wherein $R^{11}$ is a alkyl group of from about 1 to about 8 carbon atoms, preferably from about 3 to about 6, and wherein A is an alkoxy group, preferably propoxy and/or ethoxy, and q is an integer of from 1 to 5, preferably from 1 to 2. Suitable alcohols are butoxy propoxy propanol (n-BPP), butoxy propanol (n-BP), butoxyethanol, or mixtures thereof. Suitable alkoxylated aromatic alcohols to be used herein are those according to the formula $R^{12}$—$(B)_r$—OH wherein $R^{12}$ is an alkyl substituted or non-alkyl substituted aryl group of from about 1 to about 20 carbon atoms, preferably from about 2 to about 15, and more preferably from about 2 to about 10, wherein B is an alkoxy group, preferably a butoxy, propoxy and/or ethoxy, and r is an integer of from 1 to 5, preferably from 1 to 2. A suitable aromatic alcohol to be used herein is benzyl alcohol. Suitable alkoxylated aromatic alcohol is benzylethanol and or benzylpropanol. Other suitable solvent includes butyl diglycolether, benzylalcohol, propoxypropoxypropanol (EP 0 859 044) ether and diether, glycol, alkoxylated glycol, $C_6$-$C_{16}$ glycol ether, alkoxylated aromatic alcohol, aromatic alcohol, aliphatic branched alcohol, alkoxylated aliphatic branched alcohol, alkoxylated linear $C_1$-$C_5$ alcohol, linear $C_1$-$C_5$ alcohol, amine, $C_8$-$C_{14}$ alkyl and cycloalkyl hydrocarbon and halohydrocarbon, and mixtures thereof.

Perfume

The liquid cleaning composition of the present invention may comprise a perfume ingredient, or mixtures thereof, in amount up to about 5.0% by weight of the total composition, preferably in amount of about 0.1% to about 1.5%. Suitable perfume compounds and compositions for use herein are for example those described in EP-A-0 957 156 under the paragraph entitled "Perfume", on page 13.

Dye

The liquid cleaning composition according to the present invention may be colored. Accordingly, it may comprise a dye or a mixture thereof. Suitable dyes for use herein are acid-stable dyes. By "acid-stable", it is meant herein a compound which is chemically and physically stable in the acidic environment of the composition herein.

pH Adjustment Agent

Alkaline Material

Preferably, an alkaline material may be present to trim the pH and/or maintain the pH of the composition according to the present invention. The amount of alkaline material is from about 0.001% to about 20%, preferably from about 0.01% to about 10%, and more preferably from about 0.05% to about 3% by weight of the composition.

Examples of the alkaline material are sodium hydroxide, potassium hydroxide and/or lithium hydroxide, and/or the alkali metal oxide, such as sodium and/or potassium oxide, or mixtures thereof. Preferably, the source of alkalinity is sodium hydroxide or potassium hydroxide, preferably sodium hydroxide.

Acid

The liquid cleaning composition of the present invention may comprise an acid. Any acid known to those skilled in the art may be used herein. Typically the composition herein may comprise up to about 20%, preferably from about 0.1% to about 10%, more preferably from about 0.1% to about 5%, even more preferably from about 0.1% to about 3%, by weight of the total composition of an acid.

Suitable acids are selected from the group consisting of a mono- and poly-carboxylic acid or a mixture thereof; a percarboxylic acid or a mixture thereof; a substituted carboxylic acid or a mixture thereof; and mixtures thereof. Carboxylic acids useful herein include $C_{1-6}$ linear or at least about 3 carbon containing cyclic acids. The linear or cyclic carbon-containing chain of the carboxylic acid may be substituted with a substituent group selected from the group consisting of hydroxyl, ester, ether, aliphatic groups having from about 1 to about 6, more preferably from about 1 to about 4 carbon atoms, and mixtures thereof.

Suitable mono- and poly-carboxylic acids are selected from the group consisting of citric acid, lactic acid, ascorbic acid, isoascorbic acid, tartaric acid, formic acid, maleic acid, malic acid, malonic acid, propionic acid, acetic acid, dehydroacetic acid, benzoic acid, hydroxy benzoic acid, and mixtures thereof.

Suitable percarboxylic acids are selected from the group consisting of peracetic acid, percarbonic acid, perboric acid, and mixtures thereof.

Suitable substituted carboxylic acids are selected from the group consisting of an amino acid or a mixture thereof; a halogenated carboxylic acid or a mixture thereof; and mixtures thereof.

Preferred acids for use herein are selected from the group consisting of lactic acid, citric acid, and ascorbic acid and mixtures thereof. More preferred acids for use herein are selected from the group consisting of lactic acid and citric acid and mixtures thereof. An even more preferred acid for use herein is lactic acid.

Suitable acids are commercially available from JBL, T&L, or Sigma. Lactic acid is commercially available from Sigma and Purac.

Salt

In a preferred embodiment, the liquid cleaning composition of the present invention also comprises other salts as the pH buffer. Salts are generally present at an active level of from about 0.01% to about 5%, preferably from about 0.015% to about 3%, more preferably from about 0.025% to about 2.0%, by weight of the composition.

When salts are included, the ions can be selected from magnesium, sodium, potassium, calcium, and/or magnesium, and preferably from sodium and magnesium, and are added as a hydroxide, chloride, acetate, sulphate, formate, oxide or nitrate salt to the composition of the present invention.

Diamine

In another preferred embodiment, the liquid cleaning composition of the present invention comprises a diamine or a mixture thereof as the pH buffer. The composition will preferably contain from about 0% to about 15%, preferably from about 0.1% to about 15%, preferably from about 0.2% to about 10%, more preferably from about 0.25% to about 6%, more preferably from about 0.5% to about 1.5% by weight of the total composition of at least one diamine.

Preferred organic diamines are those in which $pK_1$ and $pK_2$ are in the range of from about 8.0 to about 11.5, preferably in the range of from about 8.4 to about 11, even more preferably from about 8.6 to about 10.75. Preferred materials include 1,3-bis(methylamine) cyclohexane (pKa=from about 10 to about 10.5), 1,3-propane diamine ($pK_1$=10.5; $pK_2$=8.8), 1,6-hexane diamine ($pK_1$=11; $pK_2$=10), 1,3-pentane diamine (DYTEK EP®) ($pK_1$=10.5; $pK_2$=8.9), 2-methyl-1,5-pentane diamine (DYTEK A®)) ($pK_1$=11.2; $pK_2$=10.0). Other preferred materials include primary/primary diamines with alkylene spacers ranging from $C_4$ to $C_8$. In general, it is believed that primary diamines are preferred over secondary and tertiary diamines. pKa is used herein in the same manner as is commonly known to people skilled in the art of chemistry: in an all-aqueous solution at 25° C. and for an ionic strength between about 0.1 to about 0.5 M. values. Reference can be obtained from literature, such as from "Critical Stability Constants: Volume 2, Amines" by Smith and Martel, Plenum Press, NY and London, 1975.

Chelant

It has been found that the addition of a chelant in the liquid cleaning composition of the present invention provides an unexpected improvement in terms of its cleaning capability. In a preferred embodiment, the composition of the present invention may comprise a chelant at a level of from about 0.1% to about 20%, preferably from about 0.2% to about 5%, more preferably from about 0.2% to about 3% by weight of total composition.

Suitable chelants can be selected from the group consisting of an amino carboxylate or a mixture thereof; an amino phosphonate or a mixture thereof; a polyfunctionally-substituted aromatic chelant or a mixture thereof; and mixtures thereof.

Preferred chelants for use herein are the amino acid based chelants, and preferably glutamic-N,N-diacetic acid (GLDA) and derivatives, and/or phosphonate based chelants, and preferably diethylenetriamine pentamethylphosphonic acid. GLDA (salts and derivatives thereof) is especially preferred according to the invention, with the tetrasodium salt thereof being especially preferred.

Also preferred are amino carboxylates including ethylenediaminetetra-acetate, N-hydroxyethylethylenediaminetriacetate, nitrilo-triacetate, ethylenediamine tetrapro-prionate, triethylenetetraaminehexacetate, diethylenetriaminepentaacetate, ethanoldi-glycine; and alkali metal, ammonium, and substituted ammonium salts thereof; and mixtures thereof; as well as MGDA (methylglycine-diacetic acid), and salts and derivatives thereof;

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least about two carboxyl groups which are in each case separated from one another by, preferably, no more than about two carbon atoms. Polycarboxylates which comprise two carboxyl groups include, for example, water-soluble salts of, malonic acid, (ethylenedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulphonates.

Further suitable polycarboxylates chelants for use herein include acetic acid, succinic acid, formic acid; all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Amino phosphonates are also suitable for use as chelant and include ethylenediaminetetrakis (methylenephosphonates) as DEQUEST. Preferably, these amino phosphonates do not contain alkyl or alkenyl groups with more than about 6 carbon atoms.

Polyfunctionally-substituted aromatic chelants are also useful in the composition herein, such as described in U.S. Pat. No. 3,812,044. Preferred compounds of this type in acid form are dihydroxydisulfobenzenes such as 1,2-dihydroxy-3,5-disulfobenzene.

Hydrotrope

The liquid cleaning composition of the present invention may optionally comprise a hydrotrope in an effective amount so that the composition is appropriately compatible in water. The composition of the present invention typically comprises from about 0% to about 15% by weight of the total composition of a hydrotropic, or mixtures thereof, preferably from about 1% to about 10%, most preferably from about 3% to about 6%. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903.

Polymeric Suds Stabilizer

The liquid cleaning composition of the present invention may optionally contain a polymeric suds stabilizer. These polymeric suds stabilizers provide extended suds volume and suds duration of the composition. The composition preferably contains from about 0.01% to about 15%, preferably from about 0.05% to about 10%, more preferably from about 0.1% to about 5%, by weight of the total composition of the polymeric suds booster/stabilizer.

These polymeric suds stabilizers may be selected from homopolymers of a (N,N-dialkylamino) alkyl ester and a (N,N-dialkylamino) alkyl acrylate ester. The weight average molecular weight of the polymeric suds booster, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate ester, namely the acrylate ester represented by the formula (VII):

(VII)

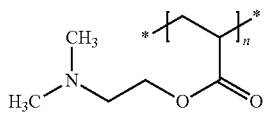

Other preferred suds boosting polymers are copolymers of hydroxypropylacrylate/dimethyl aminoethylmethacrylate (copolymer of HPA/DMAM), represented by the formulae VIII and IX (VIII)

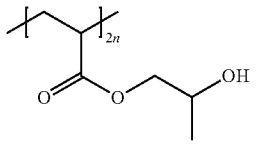

(IX)

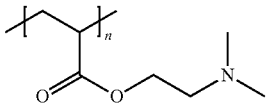

Another preferred class of polymeric suds booster polymers are hydrophobically modified cellulosic polymers having a weight average molecular weight ($M_w$) below about 45,000; preferably between about 10,000 and about 40,000; more preferably between about 13,000 and about 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

Method of Use

In the method aspect of this invention, soiled dishes are contacted with an effective amount, typically from about 0.5 ml to about 20 ml (per 25 dishes being treated), preferably from about 3 ml to about 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Suitable examples may be seen in the Example compositions below.

Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of use will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Test Methods

Molecular Weight Determination:

Molecular weight is determined as weight-average molecular weight ($M_w$) by gel permeation chromatography (GPC) using a serial configuration of the GPC columns HEMA Bio linear, 40·8 mm 10 μm, HEMA Bio 100, 300·8 mm, 10 μm, HEMA Bio 1000, 300·8 mm, 10 μm and HEMA Bio 10000, 300·8 mm, 10 μm, (obtained from PSS Polymer Standards Service GmbH, Mainz, Germany). The eluent is 1.5% aqueous formic acid, flow is 1 ml/min, injected volume is 20 μl, sample concentration is 1%. The method is calibrated with a Pullulan standard (MW 342-1660000 g/mol, obtained from PSS Polymer Standards Service GmbH, Mainz, Germany).

Shine Test Method

The formulation to be tested is diluted with tap water (water hardness: 15 gpg, temperature: 40° C.) in order to obtain a 10% solution of the original formulation. This solution is applied by a sponge to 3 drinking glasses, which are then rinsed for 10 seconds under running water (water hardness: 15 gpg; temperature: 40° C.). The glasses are stored vertically after rinsing and allowed to dry at ambient temperature (20° C.). After drying, the glasses are graded visually by two judges for shine on a 0 to 6 point scale (0=complete absence of streaks/spots; 6=extremely bad streaks/spots).

Viscosity Test Method

The viscosity of the composition of the present invention is measured on a Brookfield viscometer model # LVDVII+ at 20° C. The spindle used for these measurements is S31 with the appropriate speed to measure products of different viscosities; e.g., 12 rpm to measure products of viscosity greater than 1000 cps; 30 rpm to measure products with viscosities between 500 cps-1000 cps; 60 rpm to measure products with viscosities less than 500 cps.

EXAMPLES

Hand Dishwashing Composition Examples

Table 1 shows a known liquid cleaning composition which was prepared. The composition was prepared to show the shine benefit obtained in Hand Dishwashing by the addition of specific polyethyleneimine structures, as shown in Table 2.

TABLE 1

Cleaning Composition before adding Alkoxylated Polyethyleneimine

| Examples | (% w/w) |
|---|---|
| Alkyl ethoxy sulfate $AE_xS$* | 16 |
| Amine oxide | 5.0 |
| $C_{9-11}$ $EO_8$ | 5 |
| Ethylan 1008 ® | — |
| Lutensol ® TO 7 | — |
| GLDA[1] | 0.7 |
| DTPMP[2] | — |
| Sodium citrate | — |
| Solvent | 1.3 |
| Polypropylene glycol ($M_n$ = 2000) | 0.5 |
| Sodium chloride | 0.8 |
| Water | to balance |

*Number of carbon atoms in the alkyl chain is between 12 and 13; and x is between 0.5 and 2.

Ethylan 1008 ® is a nonionic surfactant based on a synthetic primary alcohol, commercially available from AkzoNobel.

Lutensol ® TO 7 is nonionic surfactant made from a saturated iso-$C_{13}$ alcohol.

Solvent is ethanol.

Amine oxide is coconut dimethyl amine oxide.

[1]Glutamic-N,N-diacetic acid

[2]Diethylenetriamine penta methylphosphonic acid

**Examples may have other optional ingredients such as dyes, opacifiers, perfumes, preservatives, hydrotropes, processing aids, salts, stabilizers, etc.

Table 2 shows a series of compositions prepared and tested for shine. The base formulation for all compositions was Formulation I from Table 1 above. Except for the control sample (2A), each of the compositions comprised 0.1% of an ethoxylated polyethyleneimine having the characteristics specified in the table. Shine testing was performed according to the method disclosed above. All compositions deliver good cleaning. Compositions 2A through 2G do not deliver good shine. Compositions 2H, 2I and 2J are very good on shine.

TABLE 2

Shine Benefit from Addition of Selected Modified Polyethyleneimines into Cleaning Composition

| | 2A (Control) | 2B | 2C | 2D | 2E | 2F | 2G | 2H | 2I | 2J |
|---|---|---|---|---|---|---|---|---|---|---|
| % Formulation I | 100% | 99.9% | 99.9% | 99.9% | 99.9% | 99.9% | 99.9% | 99.9% | 99.9% | 99.9% |
| % PEI | 0% | 0.1% | 0.1% | 0.1% | 0.1% | 0.1% | 0.1% | 0.1% | 0.1% | 0.1% |
| PEI Properties | | | | | | | | | | |
| PEI Backbone MW | — | 600 | 600 | 600 | 600 | 600 | 600 | 600 | 600 | 5000 |
| EO Substitution* | — | 7 | 20 | 10 | 10 | 10 | 10 | 7 | 20 | 7 |
| PO Substitution** | — | 0 | 0 | 16 | 16 | 16 | 16 | 0 | 0 | 0 |
| % Quaternization | — | 12% | 8% | 24% | 48% | 73% | 90% | 76% | 100% | 50% |
| Results | | | | | | | | | | |
| Shine Grade | 2.7 | 3.0 | 2.5 | 3.0 | 2.25 | 2.5 | 2.2 | 1.0 | 1.0 | 1.0 |

*units of ethylene oxide per unit of NH

**units of propylene oxide per unit of NH

Other Detergent Composition Examples

TABLE 3

Other Suitable Cleaning Compositions

| Examples (% w/w) | 1 | 2 | 3 | 4 | 5 |
|---|---|---|---|---|---|
| Alkyl ethoxy sulfate $AE_xS$* | 28.0 | 28.0 | 25.0 | 27.0 | 20.0 |
| Amine oxide | 7.0 | 7.0 | 7.0 | 5.0 | 5.0 |
| $C_{9-11}$ $EO_8$ | — | — | — | 3.0 | 5.0 |
| Ethylan 1008 ® | — | — | 3.0 | — | — |
| Lutensol ® TO 7 | — | — | — | — | 5.0 |
| GLDA[1] | — | — | — | — | 1.0 |
| DTPMP[2] | — | — | — | — | 0.5 |
| DTPA[3] | — | — | 1.0 | — | — |
| MGDA[4] | — | — | — | 1.0 | — |
| Sodium citrate | — | — | 1.0 | — | 0.5 |
| Solvent | 2.5 | 2.5 | 4.0 | 3.0 | 2.0 |
| Polypropylene glycol ($M_n$ = 2000) | 1.0 | 1.0 | 0.5 | 1.0 | — |
| Sodium chloride | 0.5 | 0.5 | 1.0 | 1.0 | 0.5 |
| Quaternized Alkoxylated PEI according to the present invention | 0.1 | 0.2 | 0.1 | 0.1 | 0.5 |
| Water | to balance | to balance | to balance | to balance | to balance |

| Examples (% w/w) | 6 | 7 | 8 | 9 |
|---|---|---|---|---|
| Alkyl ethoxy sulfate $AE_xS$* | 13 | 16 | 17 | 15 |
| Amine oxide | 4.5 | 5.5 | 6.0 | 5.0 |
| $C_{9-11}$ $EO_8$ | — | 2.0 | — | 5 |
| Ethylan 1008 ® | — | 2.0 | — | — |
| Lutensol ® TO 7 | 4 | — | 5 | — |
| GLDA[1] | 0.7 | 0.4 | 0.7 | 0.7 |
| DTPMP[2] | — | 0.3 | — | — |
| Sodium citrate | — | — | 0.2 | — |
| Solvent | 2.0 | 2.0 | 2.0 | 1.0 |
| Polypropylene glycol ($M_n$ = 2000) | 0.5 | 0.3 | 0.5 | 0.4 |

TABLE 3-continued

Other Suitable Cleaning Compositions

| | | | | |
|---|---|---|---|---|
| Sodium chloride | 0.5 | 0.8 | 0.4 | 0.5 |
| Quaternized Alkoxylated PEI according to the present invention | 0.1 | 0.4 | 0.1 | 0.2 |
| Water | to balance | to balance | to balance | to balance |

| Examples (% w/w) | 10 | 11 | 12 | 13 |
|---|---|---|---|---|
| Alkyl ethoxy sulfate $AE_xS$* | 16 | 29 | 18 | 20 |
| Amine oxide | 5.0 | 7.0 | 6.0 | 6.5 |
| $C_{9-11}$ $EO_8$ | 5 | — | — | 6.5 |
| Ethylan 1008 ® | — | — | — | — |
| Lutensol ® TO 7 | — | — | — | — |
| GLDA[1] | 0.7 | — | — | 1.0 |
| DTPMP[2] | — | — | — | — |
| Sodium citrate | — | — | 2.5 | — |
| Solvent | 1.3 | 4.0 | — | 2.0 |
| Polypropylene glycol ($M_n$ = 2000) | 0.5 | 1.0 | 1.0 | 0.4 |
| Sodium chloride | 0.8 | 1.5 | 0.5 | 0.5 |
| Water | to balance | to balance | to balance | to balance |

*Number of carbon atoms in the alkyl chain is between 12 and 13; and x is between 0.5 and 2.
Ethylan 1008 ® is a nonionic surfactant based on a synthetic primary alcohol, commercially available from Akzo Nobel.
Lutensol ® TO 7 is nonionic surfactant made from a saturated iso-$C_{13}$ alcohol.
Solvent is ethanol.
Amine oxide is coconut dimethyl amine oxide.
[1]Glutamic-N,N-diacetic acid
[2]Diethylenetriamine penta methylphosphonic acid
[3]Diethylene triamine pentaacetic acid
[4]Methyl glycine diacetic acid
**Examples may have other optional ingredients such as dyes, opacifiers, perfumes, preservatives, hydrotropes, processing aids, salts, stabilizers, etc.

Other Cleaning Composition Examples

The following additional examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention.

TABLE 4

Other Suitable Cleaning Compositions

| | A | B | C | D | E | F | G | H | I |
|---|---|---|---|---|---|---|---|---|---|
| Non ionic | | | | | | | | | |
| C9/11 EO 8 | 6.0 | 6.0 | 7.0 | | | 6.0 | 6.0 | 6.0 | 6.2 |
| C9/11EO 5 | | | | 3.5 | | | | | |
| C12/14 EO21 | | | | 3.5 | | | | | |
| C11 EO 5 | | | | | 7.0 | | | | |
| Anionic | | | | | | | | | |
| NaLAS | 2.00 | 2.25 | 1.8 | | | | 1.80 | 2.25 | 1.80 |
| NAPS | | | | 3.1 | 3.0 | 3.0 | | | 3.1 |
| C12-14AS | | | | | | | | | |
| NaCS | | | | | | | | | |
| Co surfactants | | | | | | | | | |
| C12-14 AO | 1.50 | 1.25 | 1.50 | 3.9 | 2.0 | | 1.50 | 1.25 | 1.50 |
| C12-14 Betaine | | | | | 1.0 | 3.0 | | | |
| Quaternized Alkoxylated | 0.1 | 0.3 | 0.5 | 0.1 | 0.2 | 0.2 | 0.4 | 0.05 | 0.3 |

TABLE 4-continued

| Other Suitable Cleaning Compositions | | | | | | | | | |
|---|---|---|---|---|---|---|---|---|---|
| | A | B | C | D | E | F | G | H | I |
| PEI accoring to the present invention | | | | | | | | | |
| Thickeners | | | | | | | | | |
| HM-polyacrylate | 0.76 | 0.65 | 0.75 | | | | 0.70 | 0.65 | 0.65 |
| HM-HEC | | | | 0.6 | 0.8 | | | | |
| X gum | | | | | | 0.42 | | | |
| Buffer | | | | | | | | | |
| Na2CO3 | 0.77 | 0.4 | 0.75 | 0.1 | 0.3 | 0.2 | 0.75 | 0.4 | 0.75 |
| Citric Acid | 0.046 | 0.3 | 0.3 | 0.75 | 0.75 | 0.3 | 0.3 | 0.3 | 0.30 |
| Caustic | 0.46 | 0.76 | 0.72 | 0.5 | 0.5 | 0.3 | 0.65 | 0.65 | 0.60 |
| Suds control | | | | | | | | | |
| Fatty Acid | 0.40 | 1.0 | 1.0 | 0.20 | 0.50 | 0.50 | 0.40 | 0.40 | 1.0 |
| Branched fatty alcohols | | | | | | | | | |
| Isofol 12 | | 0.2 | 0.1 | 0.2 | 0.3 | 0.5 | | | 0.1 |
| Isofol 16 | | | | | | | | | |
| Chelants | | | | | | | | | |
| DTPMP | | 0.3 | 0.30 | | | 0.2 | | | 0.3 |
| DTPA | 0.25 | | | | | | 0.25 | 0.25 | |
| GLDA | | | | | | | | | |
| Solvents | | | | | | | | | |
| IPA | | | | | | 2.0 | | | |
| n-BPPP | | | | | 2.0 | | | | |
| N-BP | | | | 4.0 | 2.0 | | | 2.0 | |
| Minors and Water | up to 100% | up to 100% | up to 100% | up to 100% | up to 100% | up to 100% | up to 100% | up to 100% | up to 100% |
| pH- | 10.6 | 10.5 | 10.3 | 9.5 | 9.0 | 10.0 | 10.3 | 10.5 | 10.3 |

$C_{9-11}$ $EO_5$ is a $C_{9-11}$ $EO_5$ nonionic surfactant commercially available from ICI or Shell. $C_{12,14}$ $EO_5$ is a $C_{12,14}$ $EO_5$ nonionic surfactant commercially available from Huls, A&W or Hoechst. $C_{11}$ $EO_5$ is a $C_{11}$ $EO_5$ nonionic surfactant. $C_{12,14}$ $EO_{21}$ is a $C_{12-14}$ $EO_{21}$ nonionic surfactant. NaPS is Sodium Paraffin sulphonate commercially available from Huls or Hoechst. NaLAS is Sodium Linear Alkylbenzene sulphonate commercially available from A&W. NaCS is Sodium Cumene sulphonate commercially available from A&W. Isalchem® AS is a $C_{12-13}$ sulphate surfactant commercially available from Sasol olefins and surfactants. $C_{12-14}$ AO is a $C_{12-14}$ amine oxide surfactant. $C_{12-14}$ Betaine is a $C_{12-14}$ betaine surfactant.

DMPEG is a polyethyleneglycol dimethylether. HM-HEC is a cetylhydroxethylcellulose. Isofol 12® is 2-butyl octanol commercially available from Condea. Isofol 16® is 2-hexyl decanol commercially available from Condea. n-BP is normal butoxy propanol commercially available from Dow Chemicals. IPA is isopropanol. n-BPP is butoxy propoxy propanol available from Dow Chemicals.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced ore related patent or application, is hereby incorporated herein by reference in its entirely unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

a) from about 0.01% to about 1.5% by weight of the composition of an alkoxylated polyethyleneimine polymer comprising (1) a polyethyleneimine backbone wherein the polyethyleneimine backbone has a weight average molecular weight from about 400 g/mol to about 6000 g/mol;

(2) a polyoxyethylene chain having an average of from about 1 to about 30 ethylene oxide units per unit of NH on the polyethyleneimine backbone;

(3) a quaternization permanent degree between about 75% and about 100%; and b) from about 0.5% to about 40% by weight of a surfactant selected from the group consisting of nonionic, anionic, amphoteric, zwitterionic, cationic, or a mixture thereof.

2. The liquid detergent composition according to claim 1 wherein the polyethyleneimine backbone has a weight average molecular weight of from about 400 g/mol to about 2000 g/mol.

3. The liquid detergent composition according to claim 1 wherein the polyethyleneimine backbone has a weight average molecular weight of from about 4000 g/mol to about 6000 g/mol.

4. The liquid detergent composition according to claim 1 wherein the ethylene oxide substitution level constitutes greater than 90% of the total alkoxylation of the polyethyleneimine backbone.

5. The liquid detergent composition according to claim 1 further comprising from 30% to 80% by weight of the liquid detergent composition of an aqueous liquid carrier.

6. The liquid detergent composition according to claim 1, wherein the surfactant is a sulphate or sulphonate surfactant.

7. The liquid detergent composition according to claim 6 wherein the sulfate or sulphonate surfactant is selected from the group consisting of linear alkyl sulphonate, fatty alcohol sulfate, alkyl alkoxylated sulfate, and mixtures thereof.

8. The liquid detergent composition according to claim 1 further comprising from about 0.1% to about 15% by weight of the liquid detergent composition of an amine oxide.

9. The liquid detergent composition according to claim 1 wherein the ethylene oxide substitution level of the polyethyleneimine is from about 5 to about 20 ethylene oxide units per unit of NH on the polyethyleneimine backbone.

10. The liquid detergent composition according to claim 1 wherein the composition further comprises from about 2% to about 5% by weight of the composition a $C_6$-$C_{14}$ linear or branched dialkyl sulfosuccinate.

11. The liquid detergent composition according to claim 1 further comprising from about 0.1% to about 20% by weight of the liquid detergent composition of a nonionic surfactant, cationic surfactant, or a mixture thereof.

12. The liquid detergent composition according to claim 10 wherein the nonionic surfactant is selected from the group consisting of C8-C22 aliphatic alcohols with 1 to 25 moles of ethylene oxide, alkylpolyglycosides, fatty acid amide surfactants, and mixtures thereof.

13. The liquid detergent composition according to claim 10 wherein the nonionic surfactant is selected from the group consisting of $C_8$-$C_{22}$ aliphatic alcohols with 1 to 25 moles of ethylene oxide, alkylpolyglycosides, fatty acid amide surfactants, and mixtures thereof.

14. The liquid detergent composition according to claim 1 further comprising from 0.01% to 20% by weight of the liquid detergent composition of a solvent and from 0% to about 15% by weight of the liquid detergent composition of a hydrotrope.

15. The liquid detergent composition according to claim 1 further comprising from about 0.01% to about 4% by weight of the liquid detergent composition of magnesium ions, from about 0.1% to about 15% by weight of the liquid detergent composition of a diamine, or mixtures thereof.

16. A method of washing dishes with the liquid detergent composition according to claim 1, wherein 0.01 ml to 150 ml of said liquid detergent composition is diluted in 2000 ml to 20000 ml water, and the dishes are immersed in the diluted composition thus obtained and cleaned by contacting the soiled surface of the dish with a cloth, a sponge or a similar article.

17. A method of washing dishes, wherein the dishes are immersed in a water bath or held under running water and an effective amount of a liquid detergent composition according to claim 1 is absorbed onto a device, and the device with the absorbed liquid detergent composition is contacted individually to the surface of each of the soiled dishes.

18. A method of cleaning a hard surface with a liquid cleaning composition according to claim 1, said method comprising the steps of applying the composition onto the hard surface.

* * * * *

UNITED STATES PATENT AND TRADEMARK OFFICE

CERTIFICATE OF CORRECTION

PATENT NO. : 8,623,806 B2
APPLICATION NO. : 13/469624
DATED : January 7, 2014
INVENTOR(S) : Scialla et al.

It is certified that error appears in the above-identified patent and that said Letters Patent is hereby corrected as shown below:

In the Claims

Column 26

Claim 1, Line 66, delete "quaternization permanent" and insert --permanent quaternization--.

Signed and Sealed this
Eleventh Day of March, 2014

Michelle K. Lee

Michelle K. Lee
*Deputy Director of the United States Patent and Trademark Office*